United States Patent [19]

DiGirolamo et al.

[11] 4,207,673

[45] Jun. 17, 1980

[54] CUTTLERY

[76] Inventors: Mariam E. DiGirolamo; Joseph E. DiGirolamo, both of 5 Page St., Danvers, Mass. 01923

[21] Appl. No.: 929,349

[22] Filed: Jul. 31, 1978

[51] Int. Cl.[2] ..... B25F 3/00

[52] U.S. Cl. ..... 30/142; 30/123

[58] Field of Search ..... 30/142, 123

[56] References Cited

U.S. PATENT DOCUMENTS

| | | | |
|---|---|---|---|
| 51,748 | 12/1865 | Pearson | 30/123 |
| 1,206,585 | 11/1916 | Parrahm | 30/123 |
| 1,619,878 | 3/1927 | Morgan et al. | 30/123 |
| 1,988,379 | 1/1935 | Gilles | 30/123 |
| 3,510,643 | 5/1970 | File | 30/123 |
| 3,784,206 | 1/1974 | Sluss | 273/158 |
| 3,839,793 | 10/1974 | Crapio | 30/123 |

FOREIGN PATENT DOCUMENTS

| | | | |
|---|---|---|---|
| 268013 | 4/1950 | Switzerland | 30/123 |
| 9256 | 8/1885 | United Kingdom | 30/123 |

*Primary Examiner*—Othell M. Simpson
*Assistant Examiner*—J. T. Zatarga
*Attorney, Agent, or Firm*—Robert T. Gammons

[57] ABSTRACT

An implement for assisting people in developing better eating habits comprising an instrumentality such as a fork, knife or spoon detachably attached to a hollow handle and wherein there are window openings at the top side of the handle, diodes of two different colors visible at the windows and circuitry including a battery and an on/off switch for causing the diodes to be alternately turned on and off at predetermined intervals.

9 Claims, 6 Drawing Figures

CUTTLERY

BACKGROUND OF INVENTION

The implement as conceived herein in its several forms is designed to help people slow down their eating time and thus control their diet by making the person partake of food at sufficiently spaced intervals timed to give the digestive juices time to work in the stomach and, in doing so, afford the stomach the opportunity to signal the brain that the stomach is full. The overeater simply overloads his stomach before his inbuilt warning system tells him that he has eaten too much.

SUMMARY OF INVENTION

As herein illustrated, the implement of the invention comprises an instrumentality, a handle by means of which it may be manipulated and means carried by the handle which, at predetermined intervals, signals the use and non-use of the instrumentality for its intended purpose. The handle is hollow, has one or more window openings at its upper side, and the signal means comprises light emitting means such as diodes of different colors visible through the window openings. There is circuitry internally of the hollow handle including a battery and externally thereof an on and off switch for enabling and disabling the circuit to cause the diodes to be turned on and off at predetermined intervals. Optionally, an audible signal may be substituted for the diodes or supplement the diodes. The instrumentality may comprise a fork, knife or spoon and these are designed to be detachably connected to the handle.

The invention will now be described in greater detail with reference to the accompanying drawings, wherein.

Figure 2:
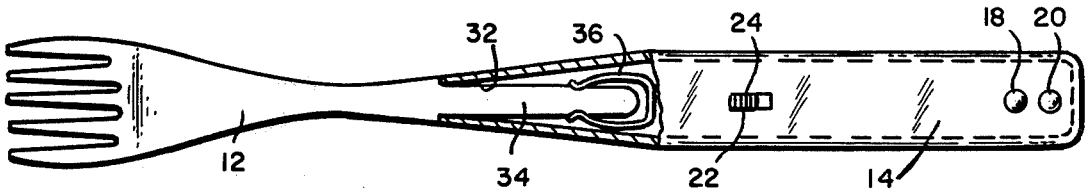
FIG. 2 is a plan view of the handle portion of the instrumentality shown in FIG. 1.
Figure 1:
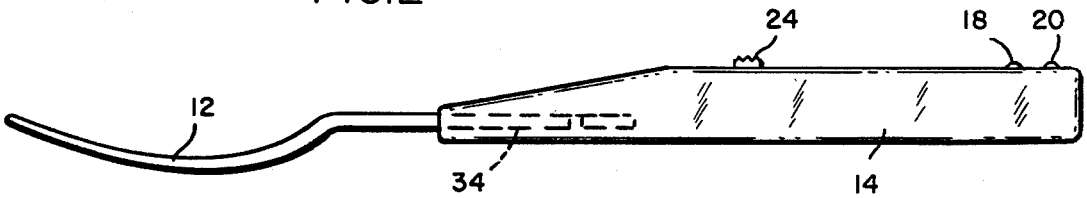
FIG. 1 is a side elevational view of the implement and wherein the instrumentality is a fork.
Figure 3:
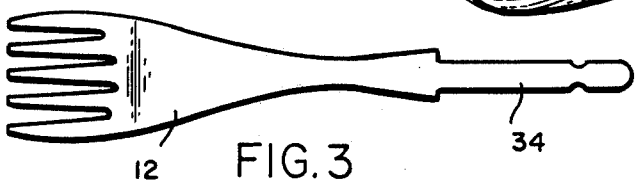
FIG. 3 is a plan view of the fork detached from the handle.

Referring to the drawings, FIGS. 1, 2 and 3, there is shown an implement 10 comprising an instrumentality 12 in the form of a fork and a handle 14 to which the fork is attached and by means of which it is manipulated for the purpose ordinarily intended for the use of a fork, to wit, eating.

Figure 6:
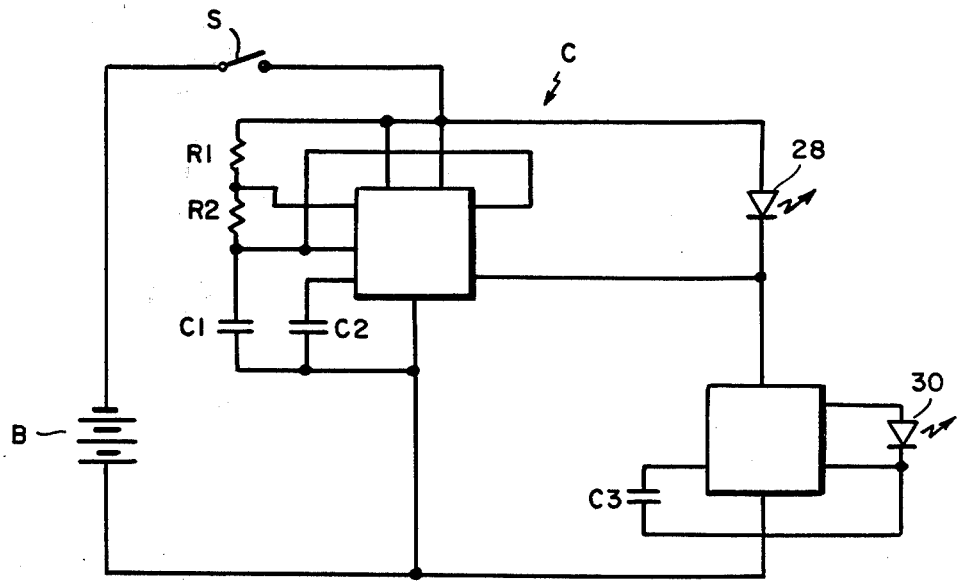
FIG. 6 is a wiring diagram.

In accordance with this invention, the handle is made hollow so as to provide internally thereof a chamber 16 that has in its upper side two longitudinally-spaced window openings 18 and 20. In addition, there is an opening 22 for receiving a toggle switch actuator 24. Within the chamber 16 there is circuitry C, FIG. 6, green and red light emitting means 28 and 30 such as light emitting diodes, a toggle switch S and a battery B connected so that the toggle switch, when turned on, will energize the circuit and cause the red and green diodes 28 and 30 to be alternately turned on and off at predetermined intervals. The diodes 28 and 30 are visible through the openings 18 and 20. Alternately, but not specifically illustrated, a diode may be used or an audible signal may be used in place of the diodes or an audible signal may be used in conjunction with two diodes. It is within the scope of the invention to provide circuitry wherein conventional lamps are employed and a motor-driven timer is used.

Desirably, the instrumentality, to wit, the fork, is detachably connected to the handle and at this end the handle is provided at one end with a socket 32 for receiving the stem 34 of the fork. In order to frictionally retain it in place, spring fingers 36—36 are provided within the socket for frictional engagement with the stem.

Figure 5:
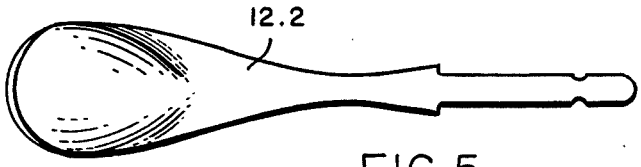
FIG. 5 is a plan view of a spoon for attachment to the handle.
Figure 4:
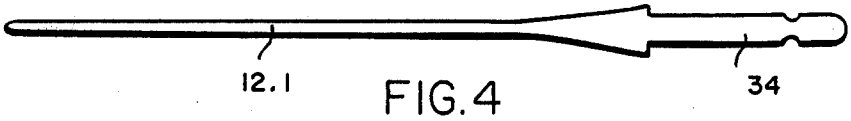
FIG. 4 is a plan view of a knife for attachment to the handle.

A knife 12.1 or spoon 12.2 may be substituted for the fork by removing the latter and inserting either the knife or spoon in its place, FIGS. 4 and 5.

While in the preferred form the implement is provided with removably attached instrumentalities, it is within the scope of the invention to make the implements up in the form of a fork, knife or spoon wherein the fork, knife or spoon is permanently fixed to the handle.

The implement as thus described is of conventional size so as to be unobjectionable because of bulkiness and, when provided with removable instrumentalities, can be washed without danger of destroying its operativeness. If lamps and a timer are used as suggested, an adjustable timer may be provided to enable adjusting the interval between the red and green lamps according to the particular individual's needs. In the diode circuitry described with reference to FIG. 6, the green diode is on for 6 seconds and off for 22 seconds and the red diode is on for 22 seconds and off for 6 seconds.

When used properly, the device enables a person to develop proper eating habits, to overcome consuming an excessive amount of food and, in the end, provides a totally harmless system for reducing one's weight to what it should be.

The instrumentalities are desirably comprised of stainless steel and the handle is comprised of plastic, the design of each being such that the components are well adapted to manufacture in high volume. The raw material such as stainless steel of which the instrumentalities are made, the PVC resins of which the handles are made and the glass, tungsten, copper and aluminum used in the circuitry are readily available.

The device is exceptionally useful in encouraging children to develop regular and proper eating habits and can be used to great advantage in homes, restaurants, hotels, motels, hospitals and nursing homes as a standard item of household wear.

It should be understood that the present disclosure is for the purpose of illustration only and includes all modifications or improvements which fall within the scope of the appended claims.

We claim:

1. A dietary control implement by means of which one may feed himself at controlled intervals of predetermined length, said implement comprising in combination an instrumentality for conveying food to the mouth, and a handle for manipulating the instrumentality, said handle embodying a signal-producing device a battery, a timer, and an on/off switch which may be turned on when the implement is being used to produce visible or audible signals at predetermined intervals while the implement is in use for indicating when the implement is to be used to convey food to the mouth and when it is not to be so used.

2. An implement according to claim 1 wherein the instrumentality is a fork.

3. An implement according to claim 1 wherein the instrumentality is a knife.

4. An implement according to claim 1 wherein the instrumentality is a spoon.

5. An implement according to claim 1 wherein the instrumentality is removably attached to the handle.

6. An implement according to claim 5 wherein the handle contains at one end a socket and the instrumentality has a stem adapted to be received within the socket.

7. An implement according to claim 6 wherein there is means for frictionally retaining the stem.

8. A dietary control implement by means of which one may feed himself at controlled intervals of predetermined length, said implement comprising in combination an instrumentality for conveying food to the mouth and a handle for manipulating the instrumentality, said handle being hollow and containing a window opening, light-emitting means visible through said window opening and circuitry including a battery, a timer and an on/off switch contained within the hollow handle.

9. A dietary control implement by means of which one may feed himself at controlled intervals of predetermined length, said implement comprising in combination an instrumentality for conveying food to the mouth and a handle for manipulating the instrumentality, said handle being hollow and containing two window openings, a diode of one color in one window and of another in the other window and circuitry including a battery, a timer and an on/off switch contained within the hollow handle for effecting alternate operation of first one diode and then the other at intervals controlled by the timer.

* * * * *